US010297209B2

(12) United States Patent
Kang

(10) Patent No.: US 10,297,209 B2
(45) Date of Patent: May 21, 2019

(54) IMAGE DISPLAY APPARATUS AND METHOD OF DRIVING THE SAME

(71) Applicant: SAMSUNG ELECTRONICS CO., LTD., Suwon-si (KR)

(72) Inventor: Shin-ho Kang, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 126 days.

(21) Appl. No.: 15/214,661

(22) Filed: Jul. 20, 2016

(65) Prior Publication Data

US 2017/0256209 A1 Sep. 7, 2017

(30) Foreign Application Priority Data

Mar. 2, 2016 (KR) ..... 10-2016-0025134

(51) Int. Cl.
*G09G 3/36* (2006.01)
*G09G 3/34* (2006.01)

(52) U.S. Cl.
CPC ... *G09G 3/3413* (2013.01); *G09G 2310/0286* (2013.01); *G09G 2320/064* (2013.01); *G09G 2320/0646* (2013.01)

(58) Field of Classification Search
CPC combination set(s) only.
See application file for complete search history.

(56) References Cited

U.S. PATENT DOCUMENTS 8,890,900 B2 * 11/2014 Kwon ..... G09G 3/342 315/169.3
2010/0149086 A1 * 6/2010 Choi ..... G09G 3/3426 345/102
2011/0084987 A1 * 4/2011 Kim ..... G09G 3/342 345/690
2013/0200808 A1 * 8/2013 Chang ..... F21V 23/0464 315/152
2017/0256209 A1 * 9/2017 Kang ..... G09G 3/3413

* cited by examiner

*Primary Examiner* — Van N Chow
(74) *Attorney, Agent, or Firm* — Sughrue Mion, PLLC

(57) ABSTRACT

A display apparatus includes a light emitter including a plurality of LEDs connected in parallel, and a driving circuit configured to turn on the plurality of LEDs and then to adjust respective turn-off time periods of the plurality of LEDs to adjust brightness of the plurality of LEDs.

17 Claims, 8 Drawing Sheets

IMAGE DISPLAY APPARATUS AND METHOD OF DRIVING THE SAME

CROSS-REFERENCE TO RELATED APPLICATION

This application claims priority from Korean Patent Application No. 10-2016-0025134, filed on Mar. 2, 2016 in the Korean Intellectual Property Office, the disclosure of which is incorporated herein by reference in its entirety.

BACKGROUND

Field

Apparatuses and methods consistent with the present disclosure relate to a display apparatus and a method of driving the same, and more particularly, a display apparatus and a method of driving the same, for simplifying a control structure of a light-emitting device in a display apparatus using, for example, a light-emitting device.

Description of the Related Art

In general, a light emitting diode (LED) as a light emitting device has attracted attention in display and illumination fields as an environment-friendly product with a long lifetime and low power consumption.

A flat panel display (FPD) technology is roughly classified into a light-receiving type display that is operated with only external light, i.e., backlight light and a light-emitting type display, i.e., a self-emitting type display that autonomously emits light. Currently, a thin film transistor liquid crystal display (TFT-LCD) that has been most popularly used is a most representative light-receiving type display product and an LED that has been largely used in an electronic board, etc. is a light-emitting type display product. An organic light emitting diode (OLED) belongs to a light-emitting display that uses three fluorescent organic compounds of red (R), green (G), and blue (B) with a self-emitting function.

In general, display products realize an image on a screen using a sequential driving method. The sequential driving method is referred to as a scan method in that scan lines (or gate lines) are sequentially driven. In other words, in the scan method, image scanning sequentially turns on the light line by line in a vertical direction to display information on a screen. When a scan-type display lights up a current line and then turns off a switching device for connection between the current line and a power source in order to light up a next line, a voltage of the current line is maintained by a parasitic capacitor of a circuit.

On the other hand, an LED backlight device used in a light-receiving type display product uses various methods. In other words, the LED backlight device has various structures according to a type of a used LED and a used driving method. Needless to say, it is assumed that the LED backlight device realizes white light. To this end, LEDs of R, G, and B may be used or an LED of white (W) may be further used. In addition, the LED backlight device is divided into regions and is separately driven for each region, and LEDs of R, G, and B are sequentially driven for each color. This method is related to how to realize an image in an image panel or a structure of an image panel. For example, a method of sequentially driving LEDs of R, G, and B for each color may be appropriate for a structure formed by omitting a color filter from a related art LCD panel.

However, with regard to such a related art display product, when the number of LED columns is increased, a structure of a system (e.g., a chip) for correspondingly controlling the brightness of the LED becomes complex and, thus, there is a need for data lines by as much as the number of the increased LED columns, for example, when the number of LED columns is increased.

SUMMARY

Exemplary embodiments overcome the above disadvantages and other disadvantages not described above. Also, the present disclosure is not required to overcome the disadvantages described above, and an exemplary embodiment may not overcome any of the problems described above.

One or more exemplary embodiments provide a display apparatus and a method of driving the same, for simplifying a control structure of a light-emitting device in a display apparatus using, for example, a light-emitting device.

According to an aspect of an exemplary embodiment, a display apparatus includes a light emitter including a plurality of light-emitting devices connected in parallel, and a driving circuit configured to turn on the plurality of light-emitting devices and then to adjust respective turn-off time periods of the plurality of light-emitting devices to adjust brightness of each of the plurality of light-emitting devices.

The light emitter may include a display panel to which at least one of light-emitting devices of red (R), green (G), blue (B), and white (W) as the plurality of light-emitting devices is connected in parallel, and the driving circuit may adjust the brightness and realize an image on the display panel.

The light emitter may include a backlight to which at least one of light-emitting devices of red (R), green (G), blue (B), and white (W) as the plurality of light-emitting devices is connected in parallel, and the driving circuit may adjust brightness of the backlight.

The driving circuit may control overall brightness of the backlight or may separately control the brightness of the backlight for each region.

The driving circuit may include a switching device connected to one terminal of each of the plurality of light-emitting devices, and the driving circuit may turn on the switching device according to a first voltage to turn on the plurality of light-emitting devices and may bypass the first voltage to a ground according to a second voltage to turn off the switching device.

A first terminal of the switching device may be connected to one terminal of each of the plurality of light-emitting devices, a second terminal may be connected to a ground, and a third terminal may receive the first voltage.

The driving circuit may include a shift register configured to convert serial input of a control signal for adjusting respective turn-off time periods of the plurality of light-emitting devices into parallel output, a logic circuit configured to logically calculate the control signal as the parallel output from the shift register, and a bypass portion configured to output the logically calculated signal as the second voltage.

The logic circuit may include a combination circuit configured to combine the control signal as the parallel output, and a sequential circuit configured to provide the logically calculated signal when the combined control signal satisfies a preset condition.

The driving circuit may include an interface or a controller configured to receive a first signal related to respective turn-on time periods of the light-emitting devices, and the interface or the controller may convert the received first signal into a second signal for adjusting the respective turn-on time periods of the light-emitting devices and may output the second signal.

According to an aspect of another exemplary embodiment, a method of driving a display apparatus includes turning on a plurality of light-emitting devices connected in parallel, and adjusting respective turn-off time periods of the plurality of light-emitting devices to adjust brightness of each of the plurality of light-emitting devices.

The display apparatus may include a display panel to which at least one of light-emitting devices of red (R), green (G), blue (B), and white (W) as the plurality of light-emitting devices is connected in parallel, and the adjusting of the brightness may include adjusting the brightness and realizing an image on the display panel.

The display apparatus may include a backlight to which at least one of light-emitting devices of red (R), green (G), blue (B), and white (W) as the plurality of light-emitting devices is connected in parallel, and the adjusting of the brightness may include adjusting brightness of the backlight.

The adjusting of the brightness may include controlling overall brightness of the backlight or separately controlling the brightness of the backlight for each region.

The display apparatus may include a switching device connected to one terminal of each of the plurality of light-emitting devices, the turning on of the plurality of light-emitting devices may include turning on the switching device according to a first voltage to turn on the plurality of light-emitting devices, and the adjusting of the brightness may include bypassing the first voltage to a ground according to a second voltage to turn off the switching device.

A first terminal of the switching device may be connected to one terminal of each of the plurality of light-emitting devices, a second terminal may be connected to a ground, and a third terminal may receive the first voltage.

The method may further include converting serial input of a control signal for adjusting respective turn-off time periods of the plurality of light-emitting devices into parallel output, logically calculating the control signal as the parallel output, and outputting the logically calculated signal as the second voltage.

The logically calculating may include combining the control signal as the parallel output, and providing the logically calculated signal when the combined control signal satisfies a preset condition.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Certain exemplary embodiments will now be described in greater detail with reference to the accompanying drawings.

Figure 1:
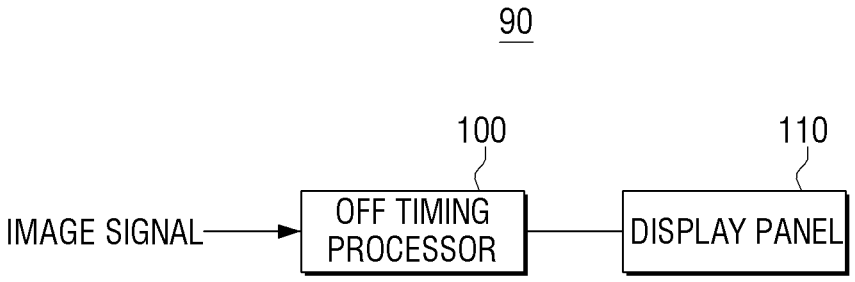
FIG. 1 is a block diagram illustrating a configuration of a display apparatus according to a first exemplary embodiment.
Figure 2:
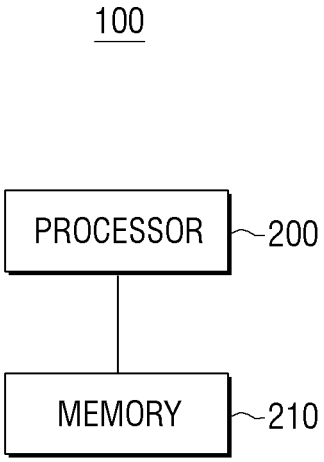
FIG. 2 is a block diagram illustrating an example of a configuration of an off timing processor of FIG. 1.

FIG. 1 is a block diagram illustrating a configuration of a display apparatus 90 according to a first exemplary embodiment. FIG. 2 is a block diagram illustrating an example of a configuration of an off timing processor 100 of FIG. 1.

As illustrated in FIG. 1, the display apparatus 90 according to the first exemplary embodiment may include the off timing processor 100 and a display panel 110.

Here, the off timing processor 100 may be a driving circuit of the display apparatus 90 and may have structurally various forms. In other words, the off timing processor 100 may be operated by storing a program in a read only memory (ROM) or EEPROM and then executing the stored program for image processing. At this process, a control function may also be performed by executing a program. Alternatively, the off timing processor 100 may include a processor 200 for performing a control function and a memory 210 for storing a program, as illustrated in FIG. 2. Here, the processor 200 may perform an overall control operation of the display apparatus 90 and perform processing for off timing control, and the memory 210 may store a program required for image processing and then may be operated under control of the processor 200.

The processor 200 may be, for example, a microcomputer circuit (or a microcomputer) and may include a peripheral circuit such as a microprocessor (central processing unit (CPU)) and an interface, and the CPU may include a control circuit, a command interpreter, a calculator (arithmetic logic unit (ALU)), and so on.

When the display panel 110 includes a light-emitting device such as an LED, the processor 200 of the off timing processor 100 may have a structure illustrated in FIG. 5, which will be described later. This is because the processor 200 is related to control of off timing of the light-emitting device included in the display panel 110.

In addition, the off timing processor 100 according to an exemplary embodiment may have different structures according to whether the display panel 110 has a self-emitting type structure or a light-receiving type structure. When the display panel 110 has a self-emitting type structure, the display panel 110 may form an OLED or LED panel without a separate backlight, and when the display panel 110 has as light-receiving type structure, the display panel 110 may include an LED backlight and an LCD panel. The former case will be described below in detail with reference to FIG. 3 and the latter case will be described below in detail with reference to FIG. 4.

Figure 7:
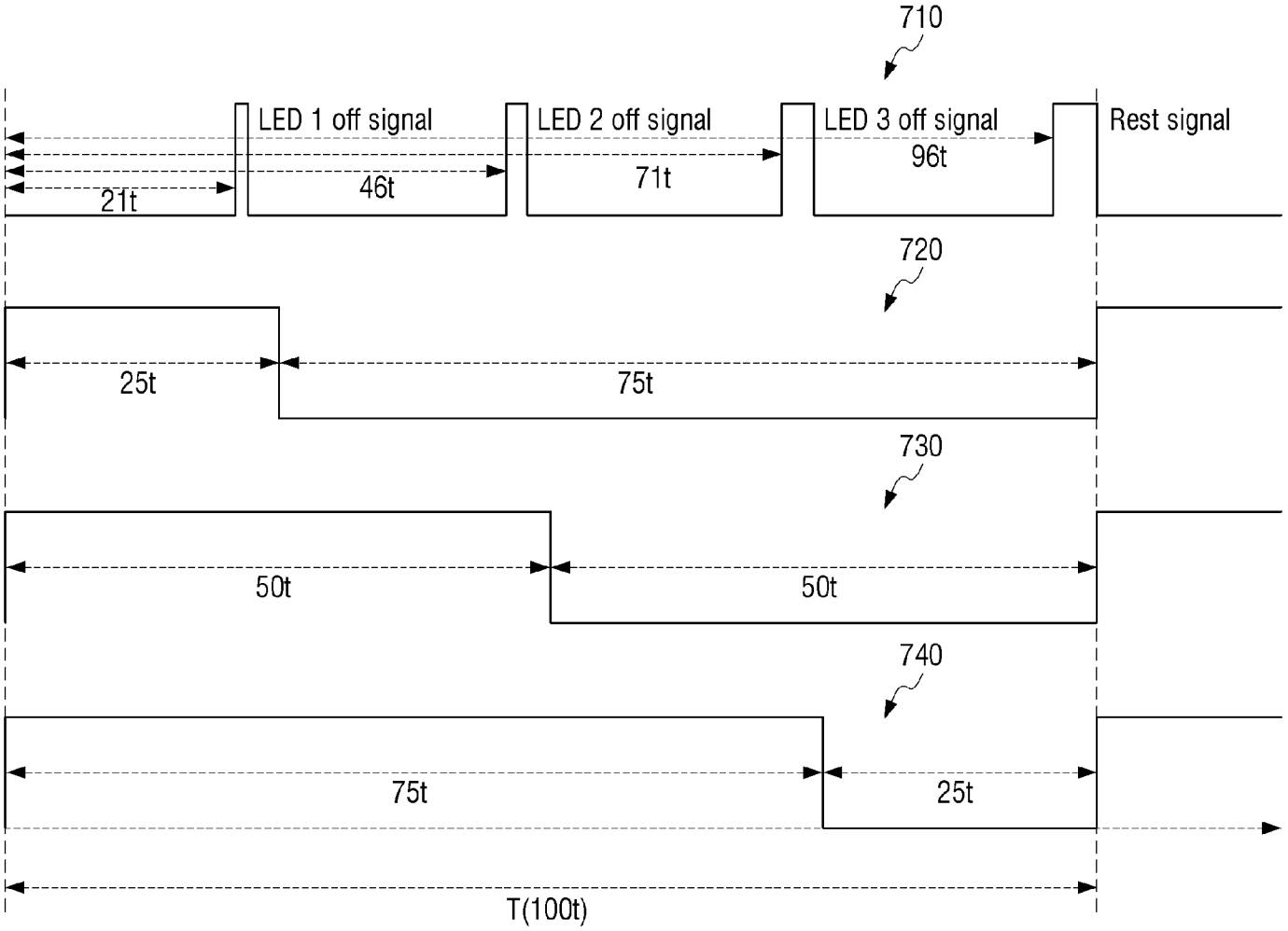
FIG. 7 is a timing diagram for an operation of an LED driver of FIG. 6.

The off timing processor 100 according to an exemplary embodiment may analyze an image signal input from an external source, e.g., video data to generate and output, for example, an LED PWM control signal for off timing control. Here, the image signal may include additional information such as video data, audio data, and subtitle information. In addition, the video data may include a pixel value so as to be provided to pixels of the display panel 110, that is, light-emitting devices of R, G, and B. When the pixel value is expressed by brightness through light-emitting devices, light-emitting devices of R, G, and B may realize one color (dot) corresponding to a pixel. In this case, a pixel value (or a brightness value) representing brightness of a light-emitting device of, e.g., R may be represented by 6-bit or 8-bit information, and the off timing processor 100 may analyze the bit information to generate a PWM signal as a control signal with determined off timing (or a turn-off period). A form of the signal is shown in FIG. 7.

The off timing processor 100 according to an exemplary embodiment may form off timing of a plurality of light-emitting devices for one signal during generation of the control signal with the determined off timing. In other words, although the number of light-emitting devices constituting multiple columns may be changed according to resolution of the display panel 110, it may be deemed that light-emitting devices positioned in parallel to each other and corresponding to one horizontal line in the display panel 110 are controlled according to one off timing signal. For example, light-emitting devices corresponding to one horizontal line may be simultaneously turned on according to the off timing control signal output from the off timing processor 100 and then may be sequentially turned off to express a brightness value corresponding to corresponding one. That is, a duty on time of a light-emitting device may be adjusted due to off timing. This is merely example for explanation of an operation of the off timing processor 100 according to an exemplary embodiment. Accordingly, an exemplary embodiment is not particularly limited to the above description.

The display panel 110 may be a light emitting portion and may have a self-emitting type structure and a light-receiving type structure, as described above. When the display panel 110 has a self-emitting type structure, LEDs of R, G, and B may be respectively formed at pixel domains at which a plurality of scan lines and a plurality of data lines cross each other. Needless to say, the display panel 110 may further include an LED of W in a pixel domain and may include various types of LEDs according to use of the display panel 110. In addition, when the display panel 110 has light-receiving type structure, the display panel 110 may include an LCD panel and an LED backlight. In this case, the LCD panel may have a structure without a color filter. Here, when the LED backlight is used to realize white light, the display panel 110 may have a structure in the form of R, G, and B or R, G, B, and W, may have a modified structure of R, G, G, and B, and so on, and may be configured by only a light-emitting device of W. On the other hand, in a structure without a color filter, LED backlights need to be sequentially driven for each color and, thus, a structure including only a light-emitting device of W may not be appropriate.

For example, it is assumed that the display panel 110 according to an exemplary embodiment is an OLED or LED panel for realizing an image via self-emitting. With regard to the display panel 110, when a plurality of data lines and a plurality of scan lines are formed on a substrate, a light-emitting device such as an OLED or LED may be manufactured during the corresponding process. Alternatively, an LED module and so on, which are separately manufactured, may be assembled on a substrate on which a plurality of scan lines and a plurality of data lines are formed. Accordingly, according to an exemplary embodiment, a method of manufacture or assemble the display panel 110 may not be particularly limited.

As described above, the display panel 110 manufactured via the above procedure may be configured in such a way that a plurality of data lines and a plurality of scan lines cross each other to define (or partition) a pixel domain. In other words, the pixel domain may be formed by being surrounded (partitioned) by two lines. In addition, separate LED devices of R, G, and B may be assembled or LED devices of R, G, and B may be manufactured and assembled in the form of one package on the pixel domain. Here, "one package" may refer to a structure formed by molding chips for respectively outputting R, G, and B light with a transparent resin. In addition, the display panel 110 may be configured by repeating a specific color chip among R, G, and B chips, that is, R, R, G, and B chips, R, G, G, and B chips, or R, G, B, and B chips in the form of one package or assembling chips including W, such as R, G, B, and W in one package.

Figure 3:
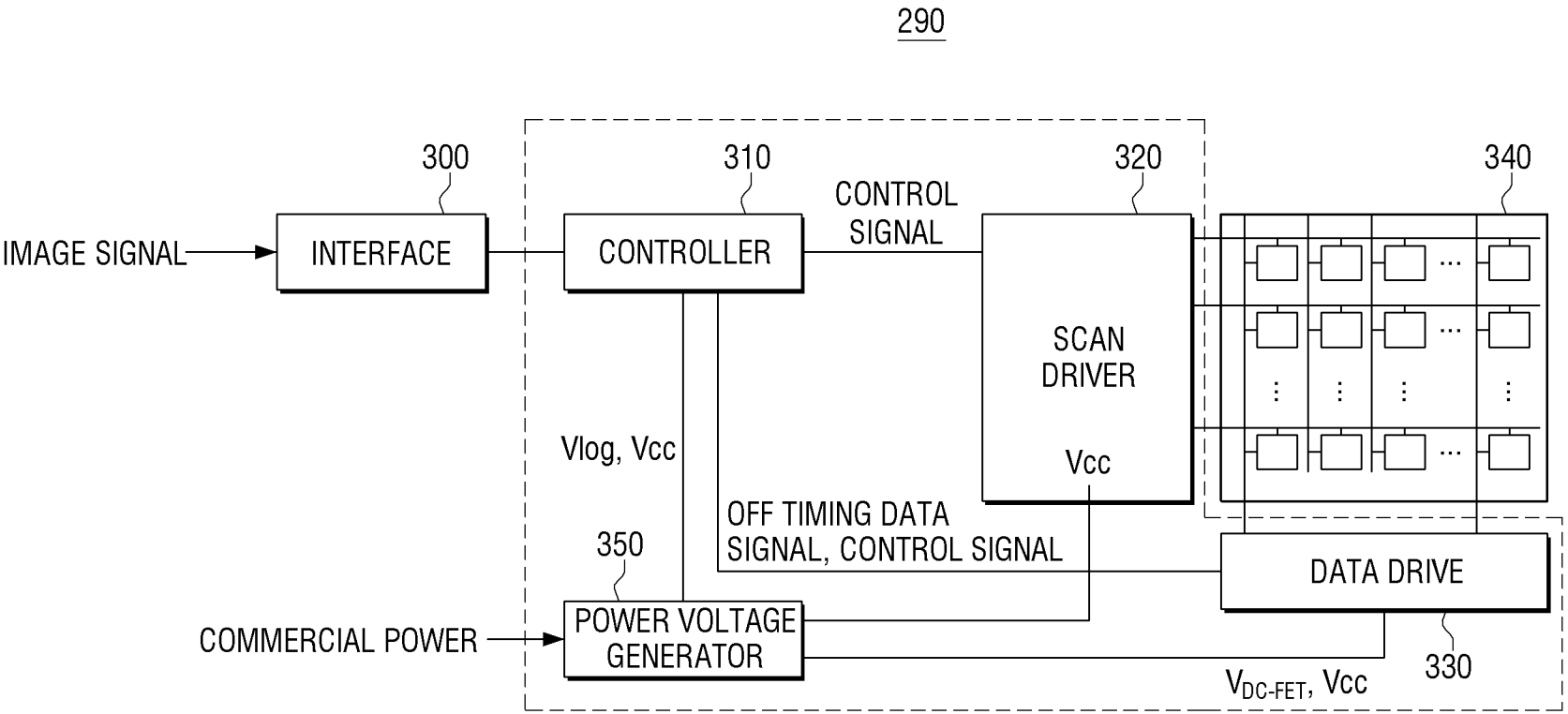
FIG. 3 is a block diagram illustrating a configuration of a display apparatus according to a second exemplary embodiment.

FIG. 3 is a block diagram illustrating a configuration of a display apparatus 290 according to a second exemplary embodiment.

As illustrated in FIG. 3, the display apparatus 290 according to the second exemplary embodiment may be a self-emitting type display apparatus and may include some or all of an interface 300, a controller 310, a scan driver 320, a data driver 330, a display panel 340, and a power voltage generator (switched mode power supply (SMPS)) 350.

Here, some or all of the interface 300, the controller 310, the scan driver 320, the data driver 330, and the power voltage generator 350 may be a driving circuit. Here, "inclusion of some or all of components" refers to the case in which some components are omitted for an apparatus configuration or some components are integrated into other components for an apparatus configuration (e.g., the scan driver 320 and/or the data driver 330 may be integrated on the display panel 340 using a chip on glass (COG) method and, thus, the case in which the display apparatus 290 includes all of the components will be described for sufficient understanding.

First, the interface 300 may be, for example, an image board such as a graphics card and may appropriately convert and output an image signal, i.e., video data input from an external source according to resolution of the display apparatus 290. Here, the video data may include, for example, video data of R, G, and B of 8 bits or more, and the interface 300 may generate control signals such as a clock signal DCLK and a vertical/horizontal synchronization signal (Vsync and Hsync), which are appropriate for the resolution of the display apparatus 290. Then, the interface 300 may provide a vertical/horizontal synchronization signal and video data to the controller 310.

In addition, the interface 300 may include a tuner for receiving a specific broadcast program provided by an external broadcaster, a demodulator for demodulating an image signal input through the tuner, a demultiplexer for dividing the demodulated image signal into video/audio data and additional information, a decoder for each decoding the divided video/audio data, an audio processor for converting the decoded audio data into a format appropriate for a speaker, and so on.

The controller 310 may generate a control signal for control of the scan driver 320 and the data driver 330 in order to display input RGB video data on the display panel 340. In addition, the controller 310 may express grayscale of R, G, B data using a logic voltage Vlog provided by the power voltage generator 350. For example, when gray-scale information of R is generated using a logic voltage of 3.3 V, 3.3 V may be represented by 1 and 0 V may be represented by 0 to generate 8-bit information "10001001".

The controller 310 may generate a gate shift clock (GSC), gate output enable (GOE), a gate start pulse (GSP), and so on as a gate signal for control of the scan driver 320. Here, the GSC may correspond to a signal for determining on/off time of a switching device connected to a light-emitting device such as R, G, and B OLED or LEDs, the GOE may correspond to a signal for control of output of the scan driver 320, and the GSP may correspond to a signal indicating a first driving line of a screen from one vertical synchronization signal. Actually, this operation corresponds to a related art LED driving method and, thus, in the present disclosure, it may be possible to use a related art method together.

In addition, the controller 310 may generate a source sampling clock (SSC), source output enable (SOE), a source start pulse (SSP), and so on as a data control signal. Here, the SSC may be used as a sampling clock for latch of data in the data driver 330 and the SOE may enable data items latched according to the SSC to be transmitted to the display panel 340. The SSP may be a signal indicating latch or sampling start during one horizontal synchronization period.

In more detail, when the data driver 330 includes an integrated circuit (IC) available from Texas Instrument Inc., the controller 310 according to an exemplary embodiment may be configured to process a signal such as a data signal, a serial data shift clock (S CLK), LAT, and grayscale (GS) pulse width modulation (PWM) reference clock (G CLK) with the corresponding IC. Here, the data signal may be grayscale data of R, G, and B. In addition, the S CLK may be a signal for synchronizing data input to the data driver 330 with a rising edge of the S CLK and shifting a shift register (e.g., 48-bit common shift register, MSB). Data stored in the shift register is shifted to MSB at each S CLK rising edge. In addition, the LAT may be a signal for latching data to a memory (e.g., a GS data memory) in MSB at a falling edge. In addition, the G CLK may be a signal for increasing a GS counter one by one at each G CLK rising edge for PWM control. The above various signals are capable of being changed and, thus, embodiments are not particularly limited to the above description. The configuration and function of the data driver 330 may be appropriately used when the display apparatus 290 according to an exemplary embodiment uses a related art method together.

Based on the above description, the controller 310 may include a control signal generator (not shown), a data re-aligner (not shown), and so on. Here, for example, assuming that time for displaying an image of a unit frame on the display panel 340 is 16.7 ms, the control signal generator may generate a control signal so as to display a unit frame image within corresponding time. In addition, the data re-aligner may re-process input RGB video data appropriately to the display panel 340. For example, the data re-aligner may perform an operation of converting 8-bit data into 6-bit data, and so on.

The controller 310 according to an exemplary embodiment may analyze the converted 6-bit data of R, G, and B or 8-bit data input from the interface 300 to generate an off timing data signal for control of light-emitting devices of the display panel 340. Needless to say, the signal may be generated by the interface 300 and provided to the controller 310, but it is general that the controller 310 forms an assembly together the display panel 340 and, thus, the off timing data signal according to an exemplary embodiment may be generated by the controller 310. In addition, it may be possible that the off timing data signal is generated in the data driver 330 and, thus, the present disclosure is not particularly limited to any one method.

The controller 310 according to the present disclosure may analyze pixel data items corresponding to one horizontal line of the display panel 340 to generate an off timing data signal for allowing a pixel value of analysis result pixel data to be expressed as brightness of each light-emitting device. For example, prior to applying the pixel data value to an arbitrary horizontal line of the display panel 340, the controller 310 may simultaneously turn on light-emitting devices of a corresponding horizontal line to realize black or white. Here, a normally black or normally white method may be related to whether black or white is realized when a voltage is applied to all light-emitting devices, which may be determined according to a designer's intention. In this case, the controller 310 may control off timing of each light-emitting device according to the off timing data signal so as to express brightness for each color light-emitting device. That is, light-emitting devices may output light with an expressed grayscale value. Through this procedure, the controller 310 may realize an image corresponding to one horizontal line and then may sequentially realize images so as to embody one unit frame image on a screen of the display panel 340. In this manner, the controller 310 may realize 30 unit frames or 60 unit frames per second on the display panel 340 so as to embody a video image.

The scan driver 320 may receive a gate on/off voltage Vcc/Vss provided from the power voltage generator 350 and apply the corresponding voltage to the display panel 340 according to control of the controller 310. However, according to an exemplary embodiment, a gate off voltage may be designed as a ground voltage. The gate on voltage Vcc may be sequentially provided to scan line N from scan line 1 GL1 in order to realize a unit frame image on the display panel 340. Needless to say, the scan driver 320 may be operated in response to a scan signal generated by the controller 310 according to an exemplary embodiment. To this end, the scan driver 320 may include a switching device connected to a power voltage source for each scan line. Needless to say, the switching device may use a TFT device but use a transistor TR and MOSFET.

The data driver 330 may convert video data of R, G, and B provided in serial by the controller 310 into data in parallel, may convert digital data into analog current or duty-on current (e.g., pulse current), may simultaneously provide video data corresponding to one horizontal line to the display panel 340, and may sequentially provide the video data for respective horizontal lines. For example, digital information of video data provided by the controller 310 may be converted into analog current for expressing a grayscale of color and provided to the display panel 340. Needless to say, the analog current may be current in the form of pulse. In this case, the data driver 330 may be synchronized with a gate signal provided to the scan driver 320 to output unit frame data. In this case, switching devices included in the data driver 330 may be controlled by off timing according to an exemplary embodiment to determine duty-on current, i.e., driving current.

In addition, a detailed configuration of the data driver 330 has been already and well known to one of ordinary skill in the art and, thus, detailed explanations thereof will be omitted since they may unnecessarily obscure the essence of the invention. In other words, the data driver 330 may be variously configured according to whether a light-emitting device is driven by constant current or constant voltage.

The display panel 340 may be configured in such a way that a plurality of scan lines and a plurality of data lines are formed to cross each other to define a pixel domain and light-emitting devices of R, G, and B such as an OLED or LED in the pixel domain. In response to a power voltage VDC-FET being applied to each scan line of the display panel 340, a current path may be formed between each scan line and a ground through the data driver 330 and light-emitting devices may generate current corresponding to grayscale information of corresponding one of the light-emitting devices through a data line connected to the corresponding scan line with the power voltage applied thereto. The display panel 340 according to an exemplary embodiment may be adjusted in brightness according to the quantity of charge flowing through the current path and may display an image. In this case, according to an exemplary embodiment, the brightness may be determined according to off timing of a light-emitting device in a turn-on state. Needless to say, it may be possible that the light-emitting device is driven by a constant voltage and, thus, an exemplary embodiment may not be particularly limited to the above description.

The power voltage generator 350 may receive commercial power, i.e., an alternating current (AC) voltage of 110 V or 220 V from an external source to generate and output a DC voltage of various levels. Voltages with various amplitudes may be generated and provided, and for example, for the controller 310, a voltage of DC 3.3 V as a logic voltage may be generated and provided in order to express a grayscale, and for the scan driver 320, a voltage of DC 4.5 V as a gate on voltage Vcc may be generated. Needless to say, when the controller 310, the scan driver 320, and the data driver 330 are configured in the form of an IC, a voltage Vcc input to the IC may be generated.

Figure 6:
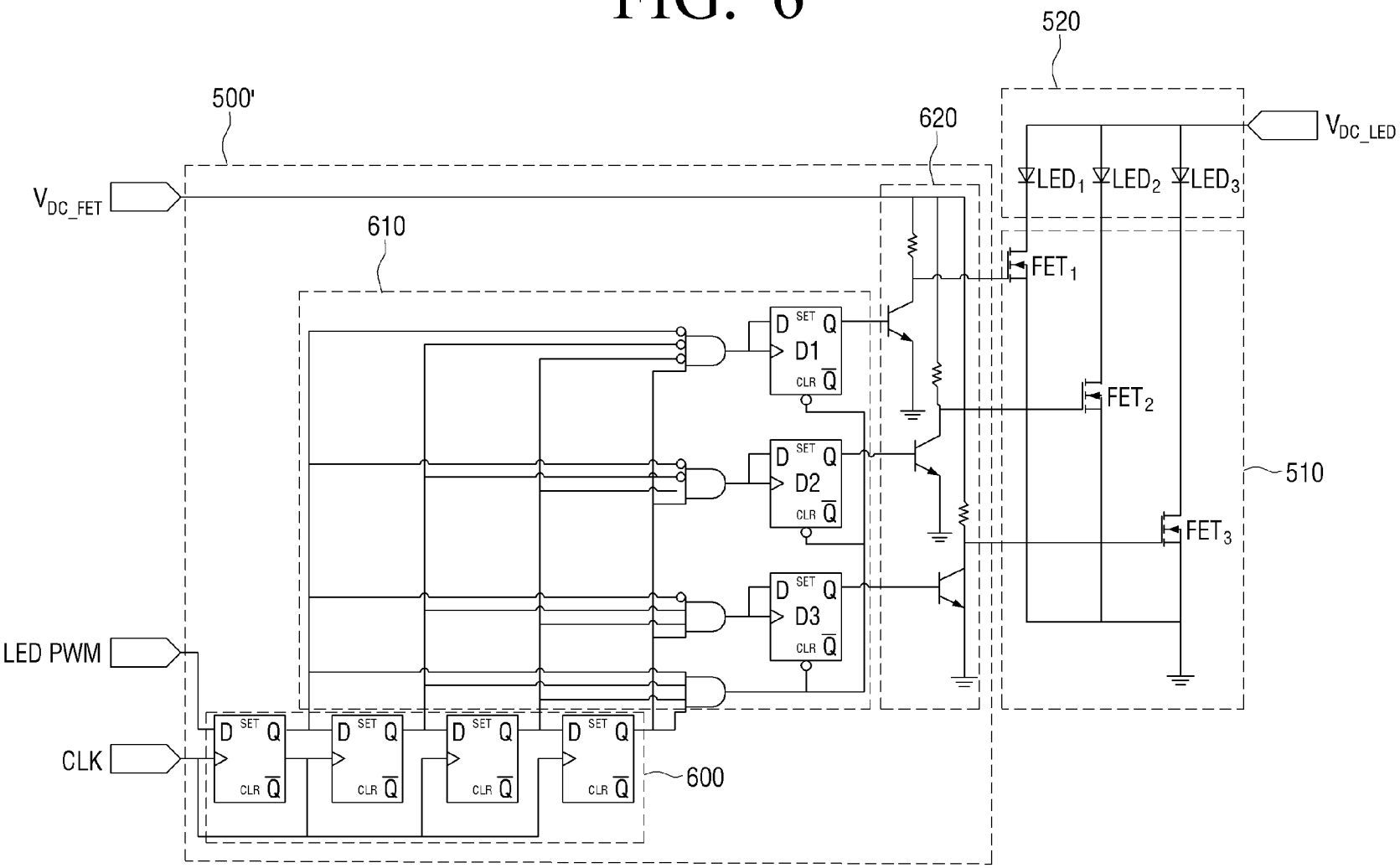
FIG. 6 is a circuit diagram illustrating a detailed configuration of FIG. 5.

In addition, the power voltage generator 350 may provide a power voltage, i.e., a switching voltage VDC-FET for simultaneously turning on switching devices connected to cathodes of light-emitting devices for respective horizontal lines to each of the switching devices in the data driver 330, which is illustrated in FIG. 6 and will be described below.

Figure 4:
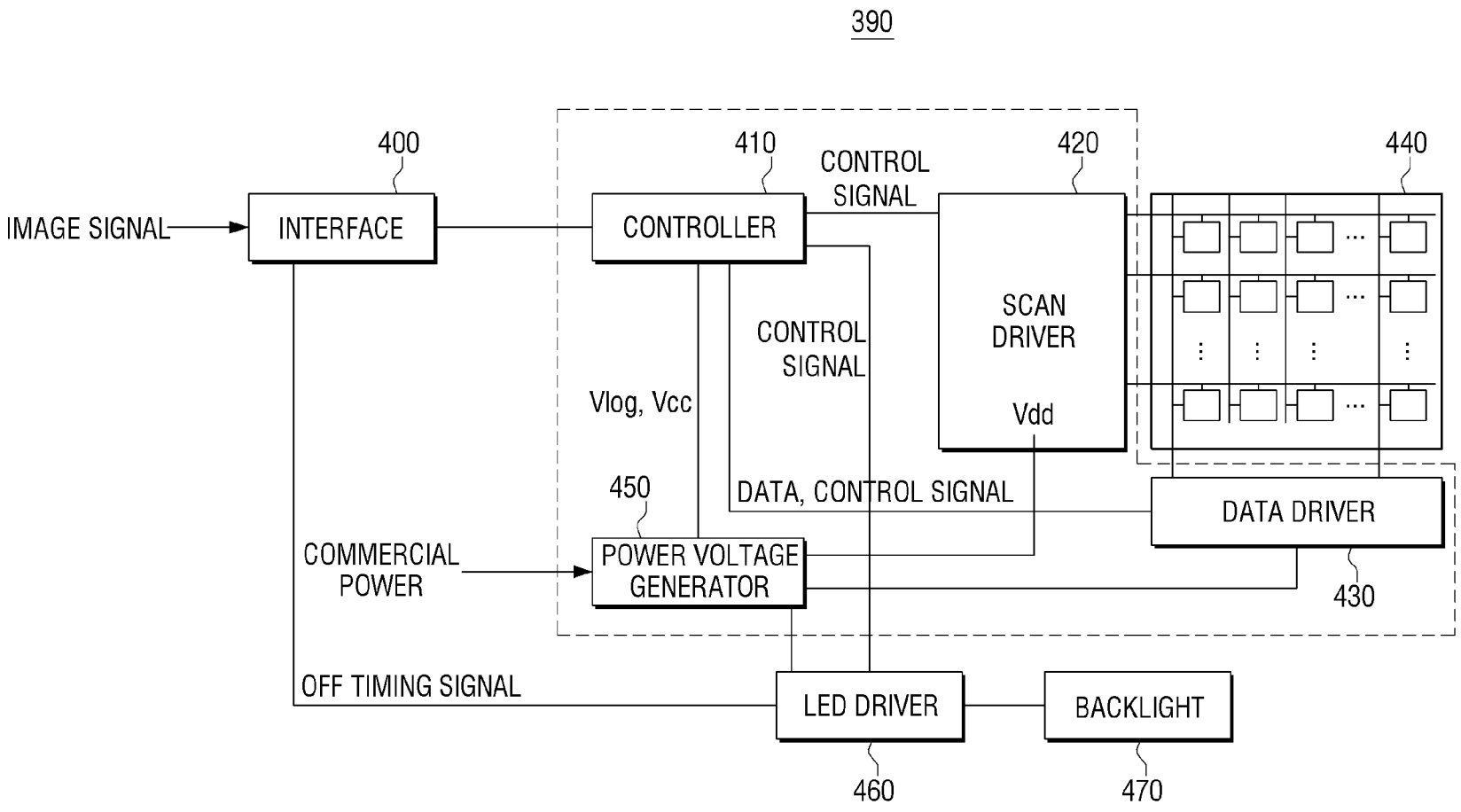
FIG. 4 is a block diagram illustrating a configuration of a display apparatus according to the second exemplary embodiment.

FIG. 4 is a block diagram illustrating a configuration of a display apparatus 390 according to the second exemplary embodiment.

As illustrated in FIG. 4, the display apparatus 390 according to the second exemplary embodiment may be a light-receiving type display apparatus and may include some or all of an interface 400, a controller 410, a scan driver 420, a data driver 430, a display panel 440, a power voltage generator 450, an LED driver 460, and a backlight 470.

Here, some or all of the interface 400, the controller 410, the scan driver 420, the data driver 430, the power voltage generator 450, and the LED driver 460 may be a driving circuit, and the "inclusion of some or all of components" has the same meaning as the above description and, thus, the case in which the display apparatus 390 includes all of the components will be described for sufficient understanding.

The display apparatus 390 of FIG. 4 is not largely different from the display apparatus 290 of FIG. 3. However, the display apparatus 390 of FIG. 4 is different from the display apparatus 290 of FIG. 3 in that the backlight 470 is embodied as a light-emitting device such as an LED since the display apparatus 390 of FIG. 4 is a light-receiving type apparatus and the backlight 470 is controlled using the above method in an exemplary embodiment.

For example, when local dimming is performed through the backlight 470, regions may be separately controlled to adjust brightness according to the off timing signal provided from the interface 400. In this case, light-emitting devices of all regions may also be turned on to realize white light or black light and, then, the regions may be separately controlled, that is, turned off so as to realize backlight light with locally adjusted brightness.

Except for this point, the display apparatus 390 of FIG. 4 is not largely different from a related art light-receiving display apparatus or the display apparatus 290 described with reference to FIG. 3 and, thus, the detailed description of the display apparatus 290 will replace a detailed description of the display apparatus 390.

However, the display panel 440 may be an LCD panel and may include both an LCD panel with a color filter and an LCD panel without a color filter. As described above, in the case of the LCD panel without a color filter, light-emitting devices of the backlight 470 may include a light-emitting device for expressing at least one color except for W. In order to realize an image, light-emitting devices of R, G, and B may be used, but an appropriate color light-emitting device may be used for use in an electronic board, etc.

Figure 5:
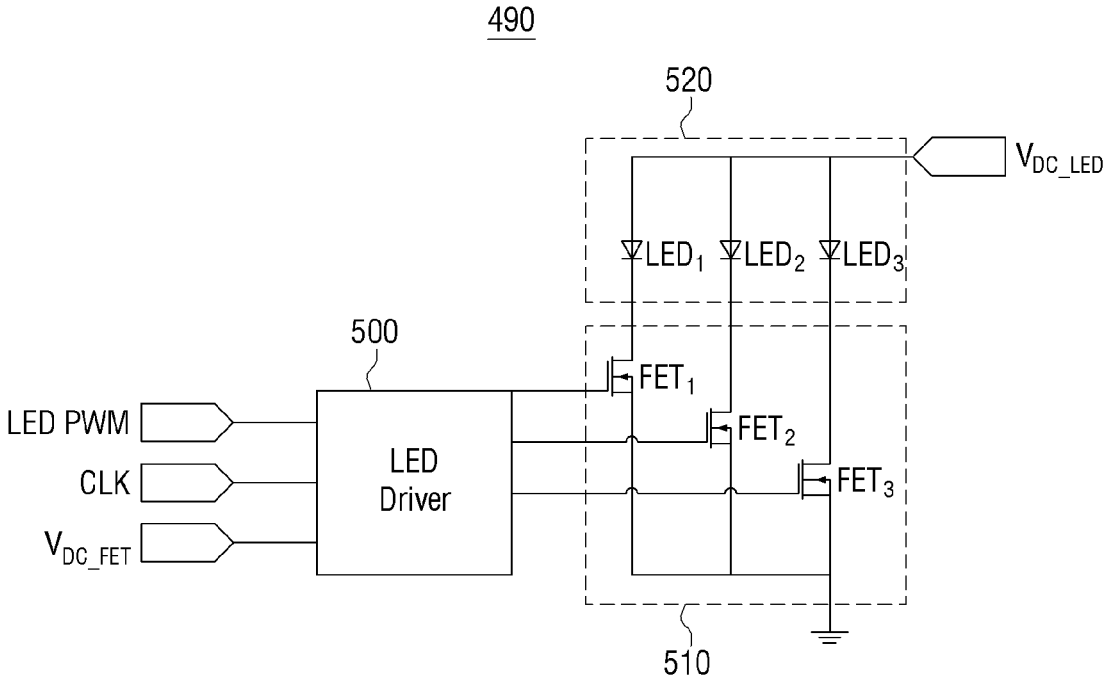
FIG. 5 is a block diagram illustrating a configuration of a display apparatus according to a third exemplary embodiment.

FIG. 5 is a block diagram illustrating a configuration of a display apparatus 490 according to a third exemplary embodiment. FIG. 6 is a circuit diagram illustrating a detailed configuration of FIG. 5. FIG. 7 is a timing diagram for an operation of an LED driver 500 of FIG. 6.

As illustrated in FIG. 5, the display apparatus 490 according to the third exemplary embodiment may include some or all of the LED driver 500, a switching portion 510, and a display panel 520.

Here, some or all of the LED driver 500 and the switching portion 510 may be a driving circuit and the "inclusion of some or all of components" may refer to the case in which some components such as the switching portion 510 are integrated into other components such as the display panel 520. For sufficient understanding, the case in which the display apparatus 490 includes all of the components will be described.

For convenience of description, referring to FIG. 5 together with FIG. 3, the LED driver 500 and the switching portion 510 illustrated in FIG. 5 may be configured by integrating, for example, some or all of the controller 310, the scan driver 320, and the data driver 330 illustrated in FIG. 3. In this case, the controller 310 may further include the LED driver 500 illustrated in FIG. 6. However, comparing FIG. 5 with FIG. 3, FIG. 5 is slightly different from FIG. 3 in that the LED driver 500 receives an off timing data signal or LED PWM signal generated by, e.g., the interface 300 of FIG. 3. In this case, the LED driver 500 may receive a clock signal from a clock signal generator such as an oscillator so as to reflect an LED PWM signal, more accurately, bit information corresponding thereto to the switching portion 510. In other words, in response to an LED PWM signal being received from an external source, e.g., the interface 300 of FIG. 3, the LED driver 500 may generate a control signal for determining off timing of switching devices of the switching portion 510 using a clock signal and output the control signal to the switching portion 510.

In addition, the LED driver 500 may receive a switching voltage VDC-FET provided from the power voltage generator 350 of FIG. 3. As seen from FIG. 5, an LED voltage VDC-LED may be commonly applied to an anode of light-emitting devices. In this state, in response to an LED PWM signal (Refer to 710 of FIG. 7) for control of a plurality of light-emitting devices corresponding to one horizontal line being received, the LED driver 500 may control a switching voltage VDC-FET to simultaneously turn on switching devices of the switching portion 510 related to control of light-emitting devices of a corresponding horizontal line, as illustrated in FIG. 6. As such, for example, LED devices of R, G, and B may realize a white or black image on one horizontal line.

Then, the LED driver 500 may turn off light-emitting devices corresponding to one horizontal line according to off timing so as to control brightness of each light-emitting device. For example, as illustrated in FIGS. 6 and 7, when time for maintaining one horizontal line in which three light-emitting devices, e.g., light-emitting devices of R, G, and B are formed is 100t, the light-emitting device of R may be turned off for 75t after 25t, the light-emitting device of G may represent brightness corresponding to time of 50t, and the light-emitting device of B may represent brightness corresponding to time of 75t. Long duty-on time may refer to a large quantity of charges and refer to high brightness. Colors emitted from the light-emitting devices of R, G, and B may be mixed to realize color of one pixel.

The LED driver 500 according to an exemplary embodiment may include a shift register 600, a logic circuit 610, and a bypass portion 620, as illustrated in FIG. 6. A detailed relationship may replace that of FIG. 6. However, the bypass portion 620 may include a pull-up resistor and a switching device (e.g., a TR). For example, a resistor may be connected to a collector terminal of the TR, a ground may be connected to an emitter terminal, and pull-up resistors may commonly receive a switching voltage VDC_FET. Accordingly, when a switching voltage VDC_FET is input to switching devices, the switching devices may be simultaneously turned on, and when the logic circuit 610 outputs a voltage (or a second voltage), the switching voltage is bypassed to ground while a TR may be turned on so as to turn off an FET switching device.

The shift register 600 may use RS-FF and JK-FF but the case in which the shift register 600 uses a D-FF according to an exemplary embodiment. In addition, the D-FF is exemplified as a register for right shift. Furthermore, according to an exemplary embodiment, for convenience of description, the shift register 600 for processing 4-bit bit is exemplified. The shift register 600 may be variously changed and configured according to its use and, thus, the present disclosure is not particularly limited to the above description.

In more detail, the shift register 600 may be configured in such a way that a (set) output terminal Q of a D-FF of a front end is connected to a data input terminal D of a D-FF of a next end and a (reset) output terminal of the D-FF of the front end is connected to a clock input terminal of the D-FF of the next end. In this case, bit information of an LED PWM signal may be input to a (set) output terminal Q of a first end included in the shift register 600 and a clock may be input to a (reset) output terminal.

The logic circuit 610 may include a combination circuit and a sequential circuit. The combination circuit may be formed by combining a NOT circuit or an inverter and an AND circuit. The AND circuit of the combination circuit may receive (set) output of respective D-FFs included in the shift register 600 in different inverting methods. In addition, the AND circuit may output a result according to logical operation thereof. Outputs of AND circuits may be simultaneously input as data input and clock of each D-FF. Here, each D-FF may constitute combination circuit. In this case, a clear terminal of a D-FF may be connected to output of an AND circuit of a lowermost end as illustrated in FIG. 6 illustrating a logic circuit.

The bypass portion 620 may include a switching device, e.g., a TR and a resistor connected to a collector terminal of the TR. In this case, the other terminal of the resistor may receive a switching voltage VDC_FET and one terminal connected to a collector terminal may be commonly connected to drain and gate terminals of a switching device connected to the light-emitting device. In addition, a base terminal of the TR may be connected to a (set) output terminal of a D-FF constituting the combination circuit.

Referring back to FIG. 5, the switching portion 510 may include a switching device connected to a cathode of each light-emitting device, i.e., an LED included in the display panel 520. The switching device may be an FET and may have a source terminal connected to a cathode of an LED, drain terminal that is grounded, and a gate terminal that is connected and is simultaneously connected to the LED driver 500. That is, the FET as a switching device may receive a signal (a second voltage or a second control signal) provided from the LED driver 500.

The display panel 520 has been sufficiently described above and, thus, will not be described below.

As illustrated in FIG. 6, a clock CLK may be a 4-bit clock of the shift register 600. The shift register 600 may be operated at a negative edge of the clock. The LED PWM signal may be an off signal of light-emitting devices LED 1 to LED 3. The LED PWM signal may include an off signal of light-emitting devices and a reset signal for re-lighting up light-emitting devices at last of one period T. The light-emitting devices may be normally on according to a pull-up resistor connected to a gate of switching devices FET 1 to FET 3, may be turned off according to an off signal of the LED PWM signal, and may be lit up according to a reset signal.

For example, output of D-FF 1 (D1), obtained by inputting 4-bit information "1000" to the shift register 600, may be 1, switching device 1 (FET 1) may be turned off, and light-emitting device 1 (LED 1) may also be turned off. In response to "1100" being input to the shift register 600, output of D-FF 2 (D2) may be 1, switching device 2 (FET 2) may be turned off, and light-emitting device 2 (LED 2) may also be turned off. In response to "1110" being input to the shift register 600, output of D-FF 3 (D3) may be 1 and light-emitting device 3 (LED 3) may also be turned off. In response to "1111" being input to the shift register 600, D-FFs D1 to D3 may be cleared to output 0 and light-emitting devices 1 to 3 (LED 1 to LED 3) may be re-lit up.

Referring to FIG. 7, one period T of the LED PWM signal may be 100t and one period of a clock may be t. Reference numeral 710 of FIG. 7 illustrates an LED PWM signal. In response to 1 being input for 1t after 21t, "1000" may be input to the shift register 600 after 4 clocks (4t) such that light-emitting device 1 (LED 1) is lit up for 25t and then is turned off for 75t, as illustrated in 720 of FIG. 7. In response to 1 being input for 2t after 46t, "1100" may be input to the shift register 600 after 4 clocks such that light-emitting device 2 (LED 2) is lit up for 50t and then is turned off for 50t, as illustrated in 730 of FIG. 7. In response to 1 being input for 3t after 71t, "1110" may be input to the shift register 600 after 4 clocks such that light-emitting device 3 (LED 3) is lit up for 75t and then is turned off for 25t, as illustrated in 740 of FIG. 7. In response to 1 being input for 4t after 96t, "1111" may be input to the shift register 600 after 4 clocks such that reset is 1 and light-emitting devices 1 to 3 (LED 1 to LED 3) are re-lit up. When an LED PWM signal 710 of FIG. 7 is periodically input, light-emitting device 1 (LED 1) may be lit up by 25%, light-emitting device 2 (LED 2) may be lit up by 50%, and light-emitting device 3 (LED 3) may be lit up by 75% during one period. According to a position of an off signal of light-emitting devices 1 to 3 (LEDs 1 to 3), on time of light-emitting devices 1 to 3 (LEDs 1 to 3) may be adjusted so as to control brightness thereof. Thus far, the method of converting a pulse length of an LED off into digital data to control brightness of each LED has been described according to an exemplary embodiment.

For ease description of an operation according to the present disclosure, one period of a clock is t and an entire period is 100 t. When one period of a clock is set to shorter time than t, the length of an LED off signal may become short and, thus, it may be possible to drive more LED columns.

Due to the above configuration, a system for driving multiple LED columns, for example, the display apparatus 490 may control the brightness of an LED column with (data) lines that is less or more simplified than the multiple LED columns and, thus, a printed circuit board (PCB) may be easily designed. In addition, the number of outputs of a micro control unit (MCU) or a field programmable gate array (FPGA) may be reduced so as to reduce manufacturing costs.

Figure 8:
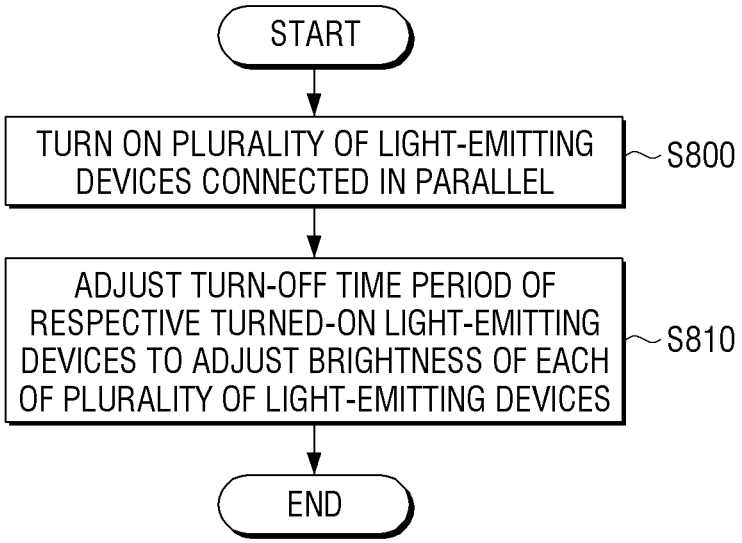
FIG. 8 is a flowchart of a procedure of driving a display apparatus according to an exemplary embodiment.

FIG. 8 is a flowchart of a procedure of driving a display apparatus 470 according to an exemplary embodiment.

For convenience of description, referring to FIG. 8 together with FIG. 5, according to an exemplary embodiment the display apparatus 470 may turn on a plurality of light-emitting devices that are connected in parallel to each other (S800). For example, the light-emitting devices may be simultaneously turned on.

Then, the display apparatus 470 may adjust turn-off time periods of respective light-emitting devices that are turned on so as to adjust brightness of each of the light-emitting devices (S810).

For example, when a unit frame image of input video data of R, G, and B is realized on a screen, the display apparatus 470 may simultaneously turn on light-emitting devices corresponding to one horizontal line and, then control the light-emitting devices according to off timing, i.e., predetermined duty-off time of each of the light-emitting devices so as to express brightness corresponding to video data of each light-emitting device. This has been sufficiently described above and, thus, will not be described any longer.

Although all elements constituting the exemplary embodiments are described as integrated into a single one or to be operated as a single one, the present disclosure is not necessarily limited to such exemplary embodiments. According to exemplary embodiments, all of the elements may be selectively integrated into one or more and be operated as one or more within the object and the scope. Each of the elements may be implemented as independent hardware. Alternatively, some or all of the elements may be selectively combined into a computer program having a program module performing some or all functions combined in one or more pieces of hardware. A plurality of codes and code segments constituting the computer program may be easily understood by those skilled in the art to which the present disclosure pertains. The computer program may be stored in non-transitory computer readable media such that the computer program is read and executed by a computer to implement embodiments.

The non-transitory computer readable medium is a medium that semi-permanently stores data and from which data is readable by a device, but not a medium that stores data for a short time, such as register, a cache, a memory, and the like. In detail, the aforementioned various applications or programs may be stored in the non-transitory computer readable medium, for example, a compact disc (CD), a digital versatile disc (DVD), a hard disc, a Blu-ray disc, a universal serial bus (USB), a memory card, a read only memory (ROM), and the like, and may be provided.

The foregoing exemplary embodiments and advantages are merely exemplary and are not to be construed as limiting the present disclosure. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus comprising:

a light emitter comprising a plurality of light-emitting devices (LEDs) connected in parallel; and a driving circuit configured to receive a pulse width modulation (PWM) signal comprising a plurality of turn-off signals for turning off the plurality of LEDs and a reset signal for turning on the plurality of LEDs, control a plurality of switches respectively based on the plurality of turn-off signals in the PWM signal to turn off the plurality of LEDs at different times with respect to each other and the reset signal to turn on the plurality of LEDs simultaneously.

2. The display apparatus as claimed in claim 1, wherein the plurality of LEDs includes a red LED, a green LED, a blue LED, and a white LED, the light emitter comprises a display panel to which at least one among the red LED, the green LED, the blue LED, and the white LED is connected in parallel; and the driving circuit is configured to form an image on the display panel by adjusting brightness.

3. The display apparatus as claimed in claim 1, wherein the plurality of LEDs includes a red LED, a green LED, a blue LED, and a white LED, the light emitter comprises a backlight to which at least one among the red LED, the green LED, the blue LED, and the white LED is connected in parallel; and the driving circuit is configured to adjust brightness of the backlight.

4. The display apparatus as claimed in claim 3, wherein the driving circuit is configured to control the brightness of the backlight by controlling an overall brightness of the backlight or by individually controlling the brightness of separate regions of the backlight.

5. The display apparatus as claimed in claim 1, wherein each of the plurality of switches is connected to one terminal of each of the plurality of LEDs, respectively; and the driving circuit is further configured to turn on the plurality of LEDs by turning on the plurality of switches based on a first voltage, and to turn off the plurality of switches by bypassing the first voltage to a ground based on a second voltage.

6. The display apparatus as claimed in claim 5, wherein each of the plurality of switches comprises:

a first terminal connected to the one terminal of each of the plurality of LEDs, respectively;

a second terminal connected to the ground; and a third terminal configured to receive the first voltage.

7. The display apparatus as claimed in claim 5, wherein the driving circuit comprises:

a shift register configured to convert a serial input of a control signal for adjusting respective turn-off time periods of the plurality of LEDs into a parallel output;

a logic circuit configured to logically calculate the control signal for adjusting the respective turn-off time periods as the parallel output from the shift register; and a bypass portion configured to output the logically calculated signal as the second voltage.

8. The display apparatus as claimed in claim 7, wherein the logic circuit comprises:

a combination circuit configured to combine the control signal for adjusting the respective turn-off time periods as the parallel output; and a sequential circuit configured to provide the logically calculated signal when the combined control signal satisfies a certain condition.

9. The display apparatus as claimed in claim 1, wherein:

the driving circuit comprises an interface or a controller configured to receive a first signal related to respective turn-on time periods of the plurality of LEDs; and the interface or the controller is configured to convert the first signal into a second signal for adjusting the respective turn-on time periods of the plurality of LEDs and output the second signal.

10. A method of driving a display apparatus, the method comprising:

receiving a pulse width modulation (PWM) signal comprising a plurality of turn-off signals for turning off a plurality of light-emitting devices (LEDs) and a reset signal for turning on the plurality of LEDs; and controlling a plurality of switches respectively based on the plurality of turn-off signals in the PWM signal to turn off the plurality of LEDs at different times with respect to each other and the reset signal to turn on the plurality of LEDs simultaneously.

11. The method as claimed in claim 10, wherein the plurality of LEDs includes a red LED, a green LED, a blue LED, and a white LED, the display apparatus includes a display panel to which at least one among the red LED, the green LED, the blue LED, and the white LED is connected in parallel; and the turning off comprises forming an image on the display panel by adjusting brightness of the plurality of LEDs.

12. The method as claimed in claim 10, wherein the plurality of LEDs includes a red LED, a green LED, a blue LED, and a white LED, the display apparatus comprises a backlight to which at least one among the red LED, the green LED, the blue LED, and the white LED is connected in parallel; and the method further comprises adjusting a brightness of the backlight.

13. The method as claimed in claim 12, wherein the adjusting the brightness comprises controlling an overall brightness of the backlight or individually controlling the brightness of separate regions of the backlight.

14. The method as claimed in claim 10, wherein each of the plurality of switches is connected to one terminal of each of the plurality of LEDs, respectively, the method further comprises turning on the plurality of LEDs by turning on the plurality of switches based on a first voltage, and the turning off comprises turning off the plurality of switches by bypassing the first voltage to a ground, based on a second voltage.

15. The method as claimed in claim 14, wherein each of the plurality of switches comprises:

a first terminal connected to the one terminal of each of the plurality of LEDs, respectively;

a second terminal connected to the ground; and a third terminal configured to receive the first voltage.

16. The method as claimed in claim 14, further comprising:

converting a serial input of a control signal for adjusting respective turn-off time periods of the plurality of LEDs into a parallel output;

logically calculating the control signal for adjusting the respective turn-off time periods as the parallel output; and outputting the logically calculated signal as the second voltage.

17. The method as claimed in claim 16, wherein the logically calculating comprises:

combining the control signal for adjusting the respective turn-off time periods as the parallel output; and providing the logically calculated signal when the combined control signal satisfies a certain condition.

* * * * *